United States Patent [19]

Rudick

[11] Patent Number: 4,804,117

[45] Date of Patent: Feb. 14, 1989

[54] DISPOSABLE SYRUP PACKAGE HAVING INTEGRAL DISPOSABLE VALVE ASSEMBLY

[75] Inventor: Arthur G. Rudick, Marietta, Ga.

[73] Assignee: The Coca-Cola Company, Atlanta, Ga.

[21] Appl. No.: 918,564

[22] Filed: Oct. 14, 1986

[51] Int. Cl.[4] ..... B65D 37/00

[52] U.S. Cl. ..... 222/214; 222/514; 222/522; 251/253

[58] Field of Search ..... 222/522, 514, 518, 509, 222/525, 214, 213, 519, 520, 402.15, 402.13; 251/253, 263

[56] References Cited

U.S. PATENT DOCUMENTS

| | | | |
|---|---|---|---|
| 1,954,986 | 4/1934 | Carlson et al. | 251/253 |
| 1,994,368 | 3/1935 | Noll | 222/525 |
| 2,585,381 | 2/1952 | Gronemeyer et al. | 222/514 |
| 2,808,185 | 10/1957 | Norris et al. | 222/214 |
| 2,822,962 | 2/1958 | Poitras | 222/481 |
| 3,402,854 | 9/1968 | Marchetti | 222/76 |
| 3,777,936 | 12/1973 | Hazard | 222/525 |
| 4,025,048 | 5/1977 | Tibbitts | 222/525 |
| 4,316,557 | 2/1982 | Benoun et al. | 222/129.1 |
| 4,475,670 | 10/1984 | Rutter | 222/519 |
| 4,496,078 | 1/1985 | Nelzow et al. | 222/87 |
| 4,523,697 | 6/1985 | Jeans | 222/185 |

FOREIGN PATENT DOCUMENTS

| | | | |
|---|---|---|---|
| 806639 | 12/1936 | France | 222/520 |

*Primary Examiner*—Joseph J. Rolla
*Assistant Examiner*—Kenneth Noland
*Attorney, Agent, or Firm*—Birch, Stewart, Kolasch & Birch

[57] ABSTRACT

A disposable syrup package includes an integral disposable valve assembly. The valve assembly includes a conduit through the discharge wall of a container which is opened or closed by a cam associated with a rotatable plate. The conduit may be formed in a spring locked plug or may include a resilient tube.

2 Claims, 2 Drawing Sheets

DISPOSABLE SYRUP PACKAGE HAVING INTEGRAL DISPOSABLE VALVE ASSEMBLY

BACKGROUND OF THE INVENTION

The present invention relates to a disposable syrup package for use in a post-mix beverage dispensing system. More specifically, the present invention relates to a disposable syrup package having an integral dispensing valve assembly disposed in a discharge end of the package.

An exemplary disposable syrup package of the prior art is disclosed in U.S. Pat. No. 4,216,885 to Sedam, issued Aug. 12, 1980 and assigned to the same assignee as the present invention. The disposable syrup package of Sedam is designed for use with a separate valve assembly included within the post-mix dispensing apparatus. The valve assembly has a piercing device which ruptures a frangible membrane in the discharge end of the syrup package as the syrup package is plugged into a socket associated with the valve assembly.

Although the Sedam syrup package and associated valve assembly work quite well it would be desirable to provide a less expensive valve assembly integrally formed with the syrup package and eliminate the frangible membrane and protective cap which is now part of the Sedam disposable syrup package.

SUMMARY OF THE INVENTION

Accordingly, it is a primary object of the present invention to provide a disposable syrup package including a disposable integral valve assembly associated with the discharge end of the syrup package.

It is another object of the present invention to provide a valve assembly associated with the discharge end of the syrup package having a minimum number of moving parts to achieve high reliability and maintain the cost of the package within reasonable limits.

The objects of the present invention are fulfilled by providing an apparatus for dispensing liquids through a discharge wall of a container comprising: conduit means disposed in an opening in the discharge wall of the container, said conduit means having an open position for accommodating the flow of liquid from the container and a closed position for blocking the flow of liquid from the container; and plate means contiguous to said discharge wall, said plate means being rotatable in a plane parallel to the plane defined by said discharge wall, said plate means including cam means for engaging said conduit means and moving said conduit means to one of said open or closed positions in response to rotation of the plate means.

In a first embodiment the conduit means is formed as a plug disposed in the opening of the discharge wall. The plug is movable in the opening by the cam means to move the conduit means into fluid communication with liquid in the container. The plug means is normally biased to a closed position by a suitable spring.

In another embodiment, the conduit means comprises a resilient tube which is operatively engaged by the cam means to normally pinch the conduit means to the closed position and in response to the rotation of the plate means, the resilient tube is opened to permit the contents of the container to be dispensed.

In another embodiment the spring biased plug may be actuated directly by the edge of a cup into which the post-mix beverage is to be dispensed.

Further scope of applicability of the present invention will become apparent from a detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
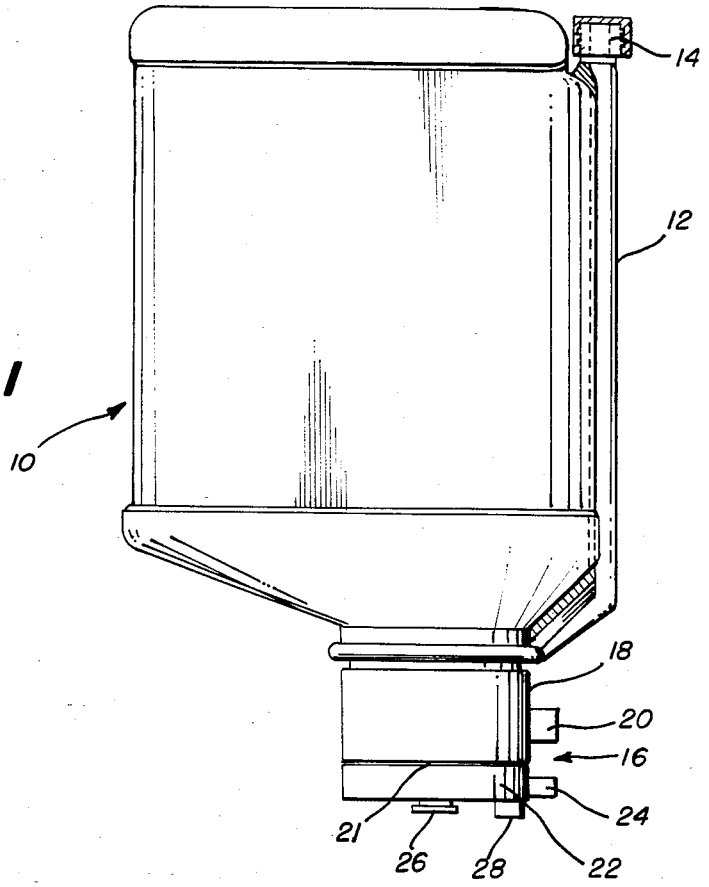
FIG. 1 is a side elevational view of a first embodiment of the syrup package of the present invention including an integral valve assembly.
Figure 2:
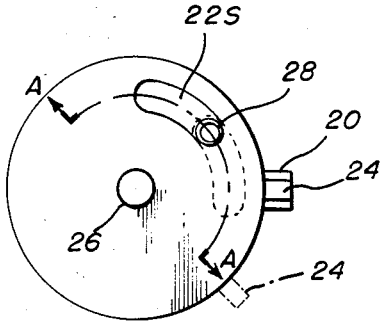
FIG. 2 is a bottom plan view of the valve assembly portion of the syrup package of FIG. 1.

Referring to FIGS. 1-3, there is generally illustrated a syrup package 10 having a flow rate control tube 12 which is normally closed to the atmosphere by a removable cap 14. The operation of the syrup package 10 including the flow rate control tube 12 is generally described and is similar to the operation of the syrup package disclosed in the aforementioned U.S. Pat. No. 4,216,885 to Sedam. However, the syrup package in FIG. 1 is also provided with an integral valve assembly generally designated 16 associated with the discharge neck of the container 18 and the discharge wall 21. As illustrated a rotatable plate 22 is provided and journaled on a pin 26 which is fixed in end wall 21. Plate 22 is free to rotate about pin 26 as an axis.

Disposed within end wall 21 of container 10 is a movable conduit assembly 30 which includes a frusto-conical top portion 32 which forms a plug in a countersunk bore 21B extending through wall 21 and an elongated stem 28. Conduit means 30 also includes a horizontal passage 34 extending transversely through frusto-conical portion 32 and a passage 36 extending longitudinally through the stem 28. Disposed on stem 28 is a flange 28F which operatively engages a coil spring 38 having its opposite end seated within an annular recess 39 in wall 21. Spring 38 normally biases conduit means 30 to a closed position wherein passage 34 is sealed within the bore 21B.

Figure 3A:
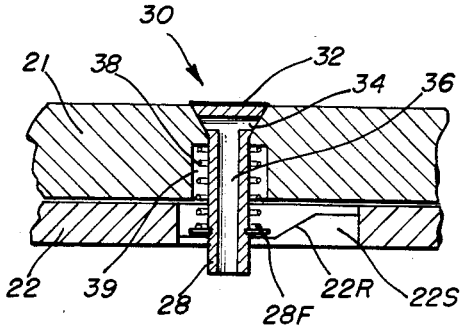
FIG. 3A and 3B are cross-sectional views taken along line A—A of FIG. 2 showing the valve assembly in the closed and open positions, respectively.
Figure 3B:
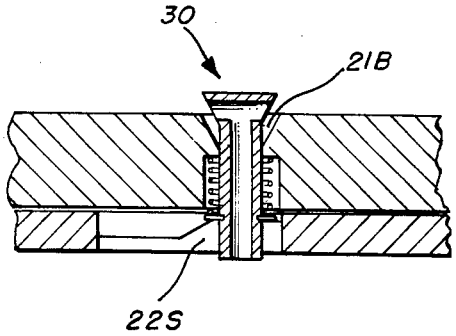

Plate 22 is provided with a slot 22S which as illustrated in FIGS. 3A and 3B has a ramp surface 22R on the underside thereof for operatively engaging flange 28F as plate 22 is rotated between the respective open and closed positions of the conduit assembly.

This is clearly illustrated in FIGS. 3A and 3B which show the closed and open positions, respectively. The respective open and closed positions are also illustrated in FIG. 2, the solid lines of slot 22S and tab 24 illustrating the closed position of the conduit assembly and the dotted line positions illustrating the open position.

A stop 20 is integrally formed with the neck 18 of container 10 and in a preferred embodiment would be held in a stationary position by a cooperating slot within a post-mix beverage dispenser (not shown). Of course, stop 20 could also be held stationary manually if desired. Actuating tab 24 on the other hand is integrally formed with rotating plate 22, and, therefore, rotation of tab 24 by any suitable means causes plate 22 to rotate about pin 26 and move slot 22S and associated ramp 22R into or out of engagement with the underside of flange 28F as illustrated in FIGS. 2, 3A and 3B. Accordingly, ramp 22R provides a cam surface on which flange 28F rides up or down as plate 22 rotates in response to a force applied to actuating tab 24.

Figure 4:
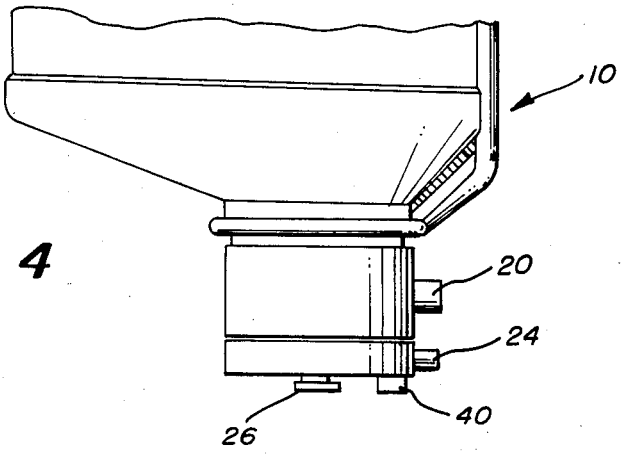
FIG. 4 is a partial side elevational view of a second embodiment of the syrup package of the present invention illustrating a different form of valve assembly.
Figure 5:
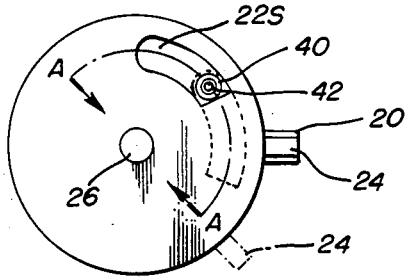
FIG. 5 is a bottom plan view of the valve assembly portion of the syrup package of FIG. 4.
Figure 6A:
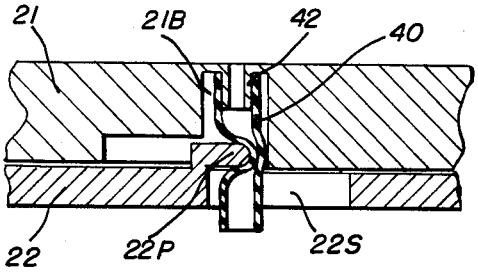
FIGS. 6A and 6B are cross-sectional views taken along line A—A of FIG. 5 illustrating the valve assembly in the closed and open positions, respectively.
Figure 6B:
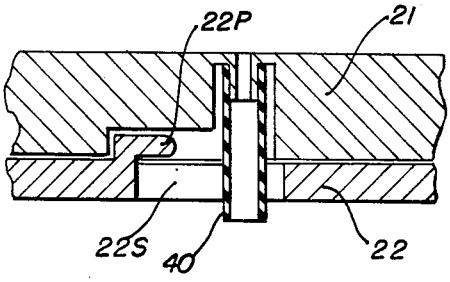

A second embodiment of the present invention and another form of integral valve assembly is illustrated in FIGS. 4–6. In this second embodiment, all parts remain essentially the same with the exception of the conduit assembly 30 and the ramp 22R. In this second embodiment, the conduit assembly 30 is replaced by a flexible tube 40 disposed on a nipple 42 within a bore 21B passing through end wall 21 of container 10. In this embodiment, the ramp 22R is replaced by a projection 22P which as clearly illustrated in FIG. 6A normally pinches tube 40 to a closed position to preclude the passage of any syrup out of container 10. A suitable snap detent mechanism may be provided between end wall 21 and rotatable plate 22 to normally hold plate 22 and projection 22P in the position illustrated in FIG. 6A. As in the embodiment of FIG. 1 when actuating tab 24 is rotated to the dotted line position of FIG. 5, projection 22P within slot 22S moves out of engagement with resilient tube 40 to permit the tube to open and accommodate the flow of syrup from a container 10.

Figure 7:
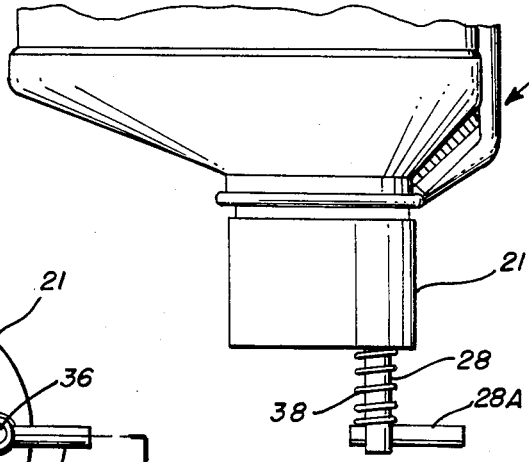
FIG. 7 is a partial side elevational view of a third embodiment of a syrup package of the present invention including an integral valve assembly.
Figure 8:
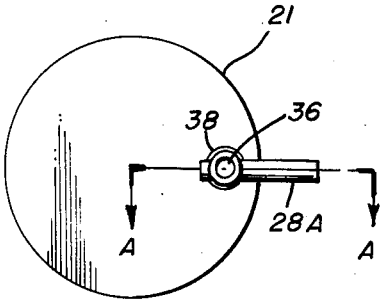
FIG. 8 is a bottom plan view of the valve assembly portion of the syrup package of FIG. 8.
Figure 9:
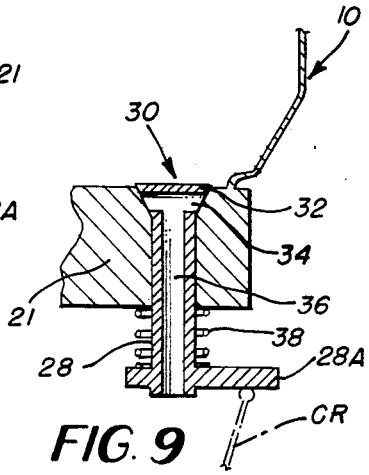
FIG. 9 is a cross-sectional view taken along line A—A of FIG. 8.

Referring to FIGS. 7–9, the conduit assembly 30 utilizes essentially the same plug structure as in the embodiment of FIG. 1 with the exception that it is not actuated by the rotatable plate 22. Instead, the stem portion 28 of conduit assembly 30 is provided with an actuating projection 28A which may be pushed upwardly by the rim CR of a cup from which the post-mix beverage is to be served. The conduit assembly 30 of FIGS. 7–9 is also provided with a coil spring 38 to normally bias the assembly to a closed position to seal off fluid accommodating passages 34,36.

Preferably all of the components of the respective conduit or valve assemblies of the present invention may be fabricated by inexpensive plastic material of a variety of forms.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. Apparatus for dispensing liquid through a discharge wall of a container comprising:

(a) conduit means including a resilient tube in an opening in the discharge wall of the container, said conduit means having an open position for accommodating the flow of liquid from the container and a closed position for blocking the flow of liquid from said container; and (b) plate means contiguous to said discharge wall, said plate means being independently rotatable on its own axis of rotation in a plane parallel to a plane defined by said discharge wall, said plate means including integral cam means offset from the axis of rotation of said plate means for engaging said conduit means in a direction radial to the longitudinal axis of said conduit means and moving said conduit means to one of said open or closed positions in response to independent rotation of the plate means, said integral cam means normally pinching said conduit means in a direction radial to the longitudinal axis of said conduit means to achieve said closed position and moving away from said tube in the radial direction to achieve said open position in response to the independent rotation of said plate means.

2. Apparatus for dispensing liquid through a discharge wall of a container comprising:

(a) conduit means disposed in an opening in the discharge wall of the container, said conduit means having an open position for accommodating the continuous flow of liquid from the container and a closed position for blocking the continuous flow of liquid from said container, said conduit means being formed in a plug disposed in said opening, said plug being movable in said opening into fluid communication with the liquid in said container to achieve said open position, said plug having a frusto-conical shaped sealing portion and an elongated stem portion slidably mounted within said end wall, said conduit means including a first passage extending transversely through said frusto-conical portion and a second passage extending longitudinally through said stem portion into fluid communication with said first passage;

(b) spring means for normally biasing said plug to close said conduit means by sealing said first passage within said opening; and (c) plate means contiguous to said discharge wall, said plate means being independently rotatable on its own axis of rotation in a plane parallel to a plane defined by said discharge wall, said plate means including integral cam means offset from the axis of rotation of said plate means for engaging said conduit means in a direction parallel to the longitudinal axis of said conduit means and moving said conduit means to one of said open or closed positions in response to independent rotation of the plate means.

* * * * *